US006378613B1

(12) United States Patent
Kent et al.

(10) Patent No.: US 6,378,613 B1
(45) Date of Patent: Apr. 30, 2002

(54) LARGE BORE SUBSEA CHRISTMAS TREE AND TUBING HANGER SYSTEM

(75) Inventors: Richard Kent, Fife; Nicholas Gatherar, Midlothian, both of (GB)

(73) Assignee: FMC Corporation, Chicago, IL (US)

( * ) Notice: Subject to any disclaimer, the term of this patent is extended or adjusted under 35 U.S.C. 154(b) by 0 days.

(21) Appl. No.: 09/501,814

(22) Filed: Feb. 10, 2000

(30) Foreign Application Priority Data

Feb. 11, 1999 (GB) ..... 9903128

(51) Int. Cl.[7] ..... E21B 7/12

(52) U.S. Cl. ..... 166/368; 166/89.3; 166/88.4; 166/84.1; 166/87.1; 277/326

(58) Field of Search ..... 166/335, 348, 166/368, 380–383, 386, 89.3, 88.1, 88.4, 84.1, 86.1, 87.1; 277/326; 285/96, 101, DIG. 920

(56) References Cited

U.S. PATENT DOCUMENTS

| | | | | |
|---|---|---|---|---|
| 3,693,714 A | 9/1972 | Baugh | | |
| 5,145,006 A | 9/1992 | June | | 166/341 |
| 5,366,017 A | 11/1994 | Voss, Jr. | | 166/368 |
| 5,450,904 A | 9/1995 | Galle | | 166/348 |

FOREIGN PATENT DOCUMENTS

| | | | |
|---|---|---|---|
| EP | 0719905 A1 | 7/1996 | E21B/33/035 |
| GB | 1549226 A | 7/1979 | E21B/33/03 |
| GB | 2214543 A | 9/1989 | E21B/33/043 |
| GB | 2254634 A | 10/1992 | E21B/33/047 |
| GB | 2275952 A | 9/1994 | E21B/33/043 |
| GB | 2287263 A | 9/1995 | E21B/33/043 |
| GB | 2291085 A | 1/1996 | E21B/34/04 |
| GB | 2320513 A | 6/1998 | E21B/33/043 |
| GB | 2321658 A | 8/1998 | E21B/33/04 |
| GB | 2326433 A | 12/1998 | E21B/23/00 |
| SU | 1590541 A | 9/1990 | E21B/33/03 |

*Primary Examiner*—Roger Schoeppel
(74) *Attorney, Agent, or Firm*—Pauley Petersen Kinne & Erickson

(57) ABSTRACT

A concentric tubing hanger having a radially offset tubing annulus passage closeable by a remotely operable valve, preferably a pressure balanced, hydraulically-operated shuttle valve positioned at an upper end of the tubing annulus passage. The tubing hanger is of relatively compact design, accommodating a large diameter production bore and a large number of downhole service lines. Service line couplers and outlet ports of the valve are housed in a void defined between the tubing hanger and a seal stab assembly of a subsea Christmas tree. The couplers are bathed in an annulus fluid. A tubing hanger running tool has a slot and an orientation helix which cooperate with a key projecting into the production bore to provide passive orientation between the tubing hanger rubbing tool and tubing hanger. A subsea Christmas tree has an annulus flow conduit having a deviated portion, allowing room in a tree block for a bypass conduit and a valve. Two or more valves in the production flow path may be substituted with crown plugs to save tree bulk and weight.

20 Claims, 7 Drawing Sheets

LARGE BORE SUBSEA CHRISTMAS TREE AND TUBING HANGER SYSTEM

FIELD OF THE INVENTION

This invention concerns subsea completions and more particularly relates to a completion arrangement that may be used to provide a large bore, high pressure, conventional (i.e. non-horizontal), concentric Christmas tree and tubing hanger system.

BACKGROUND OF THE INVENTION

For deep water developments it is now considered that conventional trees have advantages over horizontal trees. The horizontal tree concept has proven to be less advantageous than originally forecast in terms of installation times and design complexity. A demand has therefore arisen for a large bore conventional tree.

As the size of the production bore in a conventional Christmas tree and tubing hanger arrangement is increased, a large offset is often provided between the wellhead centerline and the fluid conducting bores at the tubing hanger/tree interface, primarily to avoid excessive enlargement of the tree block. In the case of parallel bore tubing hangers, this offset can arise in each of the production and tubing annulus bores. For concentric tubing hangers, there need be no offset in the production bore, but the tubing annulus offset is correspondingly larger. A very large offset in either the production bore or the tubing annulus bore will prevent wireline access.

During installation of parallel bore tubing hangers it is necessary to set wireline plugs in both bores. This requirement therefore restricts the permissible bore offsets. Tubing hangers are available which have a hydraulically operated annulus isolation valve rather than a plug. However it has usually been the practice to provide wireline access to this valve, for emergency operation in case of hydraulic actuator failure. Provision of such access and the consequent need to avoid dog legs at the tubing hanger/tree interface makes the tubing hanger and tree design relatively bulky and incapable of accommodating large numbers of downhole service lines.

Providing full wireline accessibility in a large bore conventional completion therefore leads to a large and heavy Christmas tree and tubing hanger installation. The upper weight limit for the lifting gear used to transfer equipment between supply and installation vessels is approximately 35 tonnes. This limit is reached for a conventional Christmas tree for use with 5½ inch (140 mm) tubing. We have realized that improved space utilization and various consequential design improvements are possible, both in the tubing hanger and in the tree, if wireline accessibility for the annulus isolation valve is abandoned. By this means the tubing size can be increased to seven inches (178 mm) or more while maintaining the tree weight within the 35 tonne limit and the tree dimensions likewise within acceptable limits.

SUMMARY OF THE INVENTION

Against this background, in accordance with a first aspect of the invention, we provide a tubing hanger forming a substantially centrally located production bore and a radially offset tubing annulus passage selectively closeable by a remotely operable valve; the tubing hanger upper end in use co-operating with a Christmas tree to define a void in which couplers for service lines running from the tree through the tubing hanger are accommodated; the valve communicating with the void whereby the couplers are bathed in fluid flowing to or from the annulus passage.

For large diameter production bores, this arrangement makes effective use of the space available across the horizontal section of the tubing hanger, with plenty of room around the periphery of the production bore for accommodation of service lines. For example, a hanger for seven inch (178 mm) tubing according to the present invention may accommodate up to 8 service lines; whereas the maximum number of service lines that can be accommodated in a comparable prior art parallel bore tubing hanger is 4. Currently tubing hangers for horizontal trees can only accommodate a maximum of 7 service lines. We have found that it is unnecessary to include sealing arrangements for isolating this fluid from the couplers, contrary to established practice with some prior hanger designs. The present invention may therefore provide a particularly simple and compact tubing hanger annulus passage to Christmas tree seal, capable of accommodating a relatively large number of service line couplers.

For most efficient space utilization, the valve is preferably located at the upper end of a tubing annulus passage in the tubing hanger. The valve is preferably pressure balanced, thereby requiring actuators of relatively small size and the same time being intrinsically reliable. Fluid communication between the void and the Christmas tree is preferably by means of one or more drillings extending from the void into the Christmas tree.

In a further aspect, the invention also provides means for orienting a tubing hanger and a tubing hanger running tool. Prior methods of aligning a tubing hanger and a tubing hanger running tool have included the use of an orientation joint above the tubing hanger running tool. This usually has an orientation helix and a keyway or the like, which interact with a pin or key projecting into the BOP interior. Alternatively the pin, helix and keyway may be provided between the tubing hanger running tool and the BOP. Both these arrangements involve complex manufacturing and care in use. Unless detailed records of the BOP used during the original installation of the tubing hanger are still available, there may be difficulties in setting up the orientation equipment correctly. A further orientation method involves actively rotating the completion riser at the surface to bring a spring loaded key on the running tool into alignment with a corresponding keyway in the tubing hanger. This method is impractical for deep water applications.

This further aspect of the invention provides a tubing hanger forming a substantially centrally located production bore, and a tubing hanger running tool; the running tool including a recess longitudinally engageable with a projection extending from the tubing hanger production bore, whereby the running tool may be orientated for engagement with the tubing hanger. High tolerance alignment of the running tool to the tubing hanger may thus be achieved directly and independently of any BOP; such alignment being passive, i.e. arising automatically as the running tool is landed on the tubing hanger, and effective even in deep water. The tool may also include an orientation helix to guide the projection into the recess. As it is associated with the tool, this helix does not restrict the tubing hanger production bore or require additional space within the tubing hanger. The tubing hanger production bore may also include a recess or projection for longitudinal engagement with a complementary projection or recess on a Christmas tree to provide alignment between the tree and tubing hanger.

Abandonment of wireline access to the tubing hanger annulus passage also allows a simplified, more compact and hence lighter Christmas tree to be used. Accordingly, in another aspect, the invention provides a Christmas tree having a body within which is formed a production flow bore having a lower end for connection to a tubing hanger production bore, and a tubing annulus conduit having a lower end for connection to a tubing hanger tubing annulus passage; the production flow bore and the tubing annulus conduit being interconnected by a crossover conduit formed within the tree body; the tubing annulus conduit including a deviation within the tree body, allowing room for a valve in the crossover conduit. The need for an external, separately formed, crossover conduit is thus avoided. Preferably the tree production flow bore has an upper end at the top of the tree body and is sufficiently aligned with the tubing hanger production bore to allow wireline access to the tubing hanger production bore through the tree production flow bore upper end. More preferably, the tree production flow bore is coaxial with the tubing hanger production bore which in turn is substantially centrally located within the tubing hanger.

As the production bore of a conventional tree increases in diameter, the Christmas tree height and weight also increase, partly for the reasons discussed above, concerning wireline accessibility, and partly due to the need to use larger valves. In accordance with a yet further aspect of the invention, a compact, relatively lightweight Christmas tree forms a production flow bore having a lower end for connection to a tubing hanger production bore, and a tubing annulus conduit having a lower end for connection to a tubing hanger tubing annulus passage; at least two removable plugs being provided in series in the tree production flow bore to act as pressure barriers. In conventional trees, at least one of these barriers, and more usually both, are provided by means of gate valves having large and heavy actuators. Substitution of the gate valves by plugs therefore saves considerable bulk and weight. The plugs are preferably wireline installed crown plugs.

The various aspects and preferred features of the invention are described below with reference to illustrative embodiments shown in the drawings.

DETAILED DESCRIPTION OF THE PREFERRED EMBODIMENTS

Figure 1:
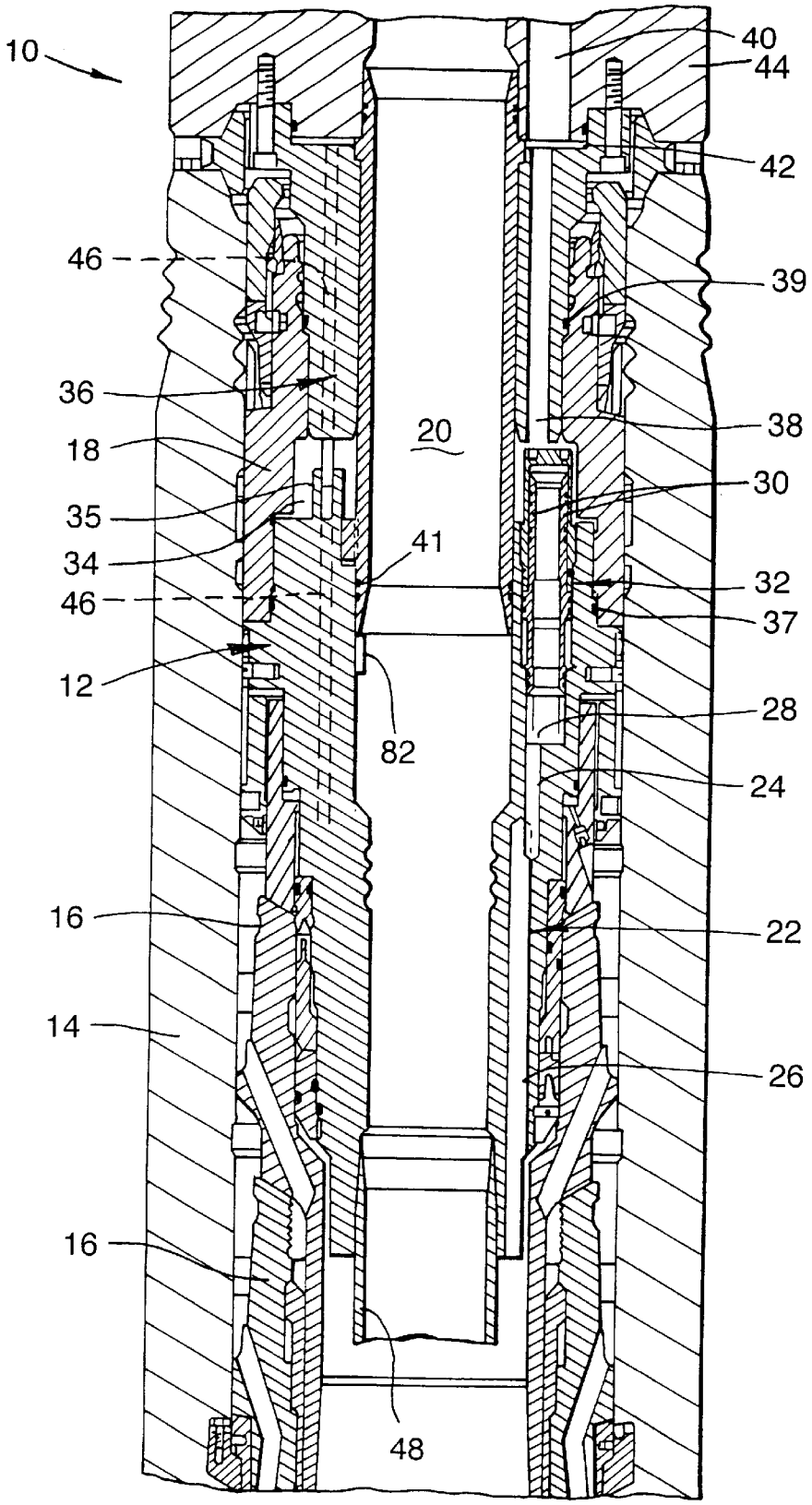
FIG. 1 shows the interface between a tubing hanger embodying the invention and a Christmas tree.

FIG. 1 shows the bottom of a Christmas tree 10 attached to a tubing hanger 12 landed in a wellhead housing 14. The tubing hanger 12 is supported by casing hangers 16 and held down by a lock down ring 18. It includes a concentric production flow bore 20 and a highly radially offset annulus flow passage 22 formed by a pair of intersecting drillings 24, 26. The upper end of the annulus flow passage 22 leads to an inlet port 28 of a pressure balanced integral shuttle valve 32, closeable for retaining annulus fluids below the tubing hanger. This valve has outlet ports 30 communicating with a void 34 formed between the top of the tubing hanger 12 and a seal stab assembly 36 of the Christmas tree 10. A circumferentially spaced series of drillings 38 in the seal stab assembly 36 (only one drilling 38 shown) communicate with an annulus flow conduit 40 in the tree 10 via an annular gap 42 formed between the seal stab assembly 36 and the tree body 44. The lower ends of the drillings 38 communicate with the void 34 thereby linking it with the Christmas tree annulus flow conduit 40.

As shown in FIG. 1, there is ample space in the seal stab assembly 36 and tubing hanger 12 for service lines, circumferentially spaced about the production flow bore 20 at a similar radius from the hanger centerline in comparison to the annulus flow conduit/passage 22, 38, 40. One such line 46 is schematically indicated in dotted lines. With seven inch (178 mm) production tubing 48, there is enough room for up to 8 circumferentially distributed service lines.

The void 34 provides space for service line couplers 35, which are bathed in the annulus fluid. The void 34 is sealed by an annular sealing ring 37 between the tubing hanger 12 and lock down ring 18, a further annular sealing ring 39 between the lock down ring 18 and the tree seal stab assembly 36 and a third annular sealing ring 41 between the tree seal stab assembly 36 and the tubing hanger 12.

The shuttle valve 32 is of similar construction to an annulus access valve disclosed in U.S. Pat. No. 5,769,162, except that it is inverted so that instead of being provided at a lower end of the tubing hanger annulus flow passage, it is situated at the upper end of the flow passage 22, in the broadest part of the tubing hanger 12. This maximizing the space available for the valve 32, besides maximizing space in the lower part of the tubing hanger for the large diameter production flow bore 20. This results in a very compact tubing hanger design.

Figure 2:
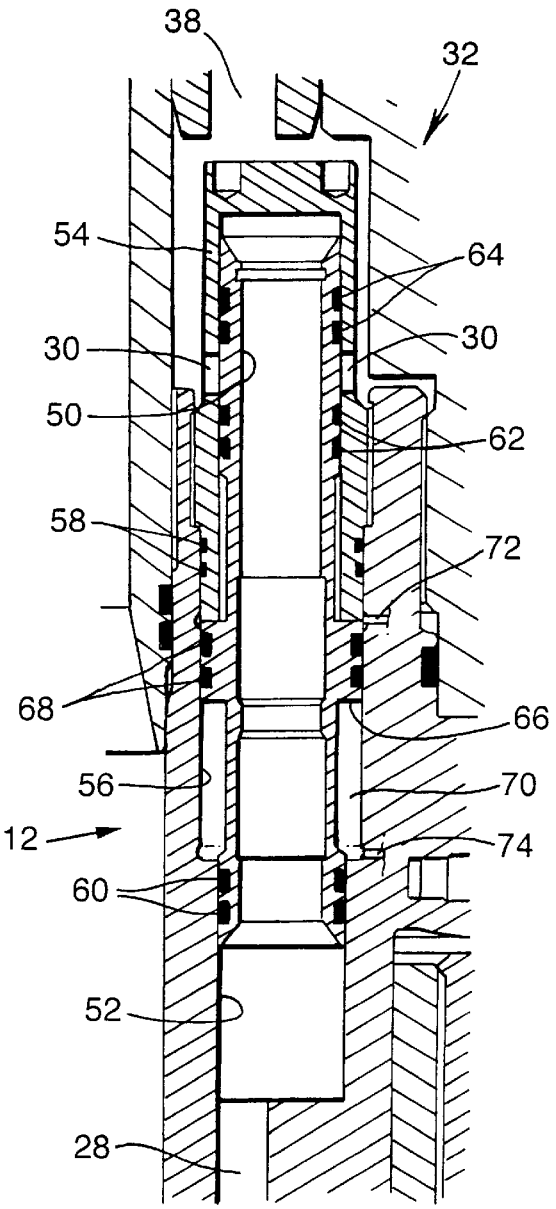
FIG. 2 shows a tubing hanger tubing annulus passage valve in more detail, in a closed position.
Figure 3:
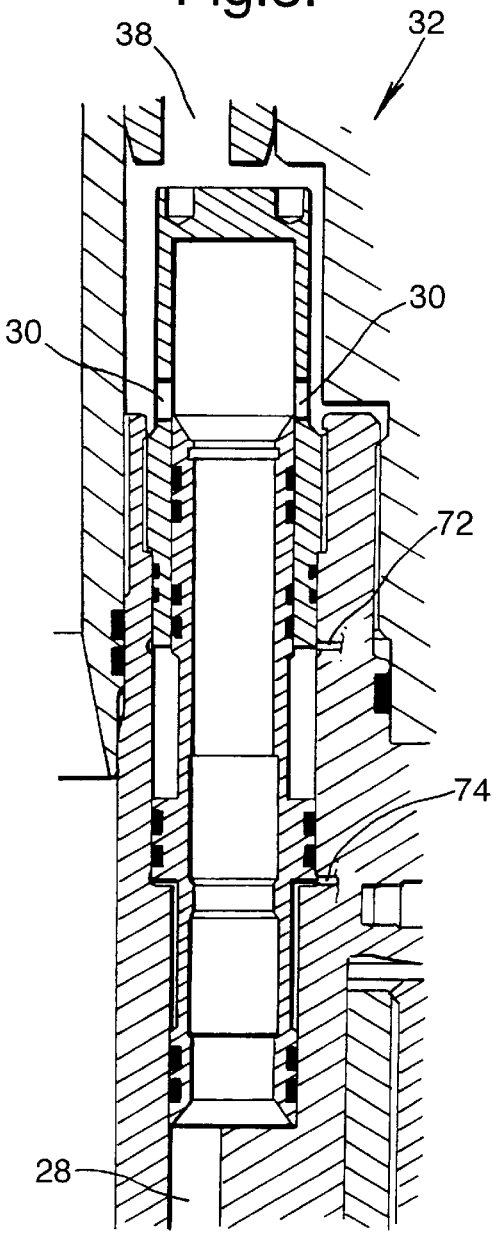
FIG. 3 shows the valve of FIG. 2 in an open position.

As shown in FIG. 2, the valve 32 comprises an open-ended tubular shuttle 50 contained partly in a bore 52 formed in the tubing hanger 12, and partly in a housing 54 screw threaded into a counter bore 56 and sealed to the counter bore 56 by O-rings 58. A lower end of the shuttle 50 carriers a pair of sealing rings 60 which make a sliding seal between the shuttle and the bore 52. An upper end of the shuttle 50 carriers two pairs of sealing rings 62, 64 which similarly make a sliding seal with the housing 54. The shuttle 50 has an external circumferential collar 66 carrying a pair of O-rings 68 which make a sliding seal with a portion of the counter bore 56 between the lower end of the housing 54 and the bore 52. This portion of the counter bore thus forms a chamber 70 within which the collar 66 slides as a piston. Hydraulic fluid is supplied to and vented from the chamber 70 through ports 72, 74. In the position shown in FIG. 2, the collar 66 lies at the upper end of the chamber 70, with the sealing rings 62, 64 lying to either side of the ports 30 to close the valve 32. In this position, supplying hydraulic fluid to the port 72 will cause the collar 66 and shuttle 50 to move downwardly, bringing the upper end of the shuttle 50 and the seals 64 below the ports 30, thus opening the valve 32. This position is shown in FIG. 3, in which position supplying hydraulic fluid to the port 74 will cause the shuttle to move upwardly, returning to the closed condition shown in FIG. 2. With the valve closed, neither annulus pressure at the port 28 nor pressure in the void 34 will tend to cause movement of the shuttle 50. The valve 32 is therefore pressure balanced and reliable in operation. The size of the collar 66 and chamber 70 required for actuation of the shuttle is therefore small.

Figure 4:
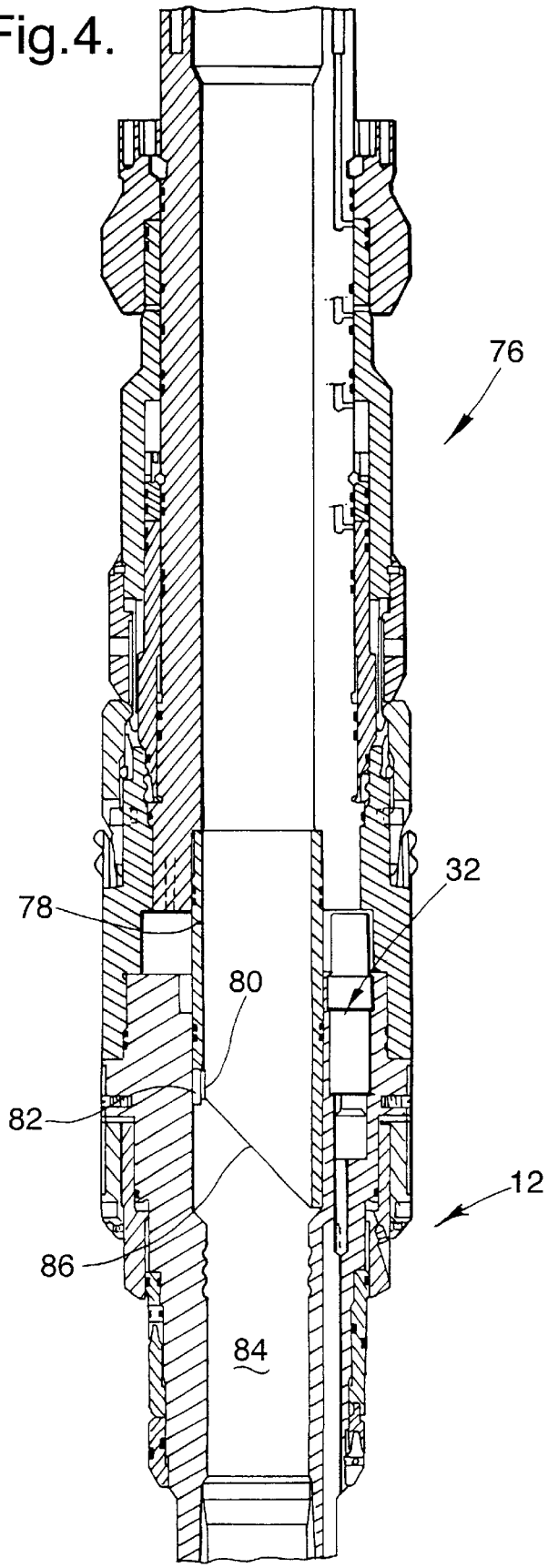
FIG. 4 shows a tubing hanger running tool engaged with the tubing hanger of FIG. 1.

FIG. 4 shows a running tool 76 engaged with the tubing hanger 12. A production flow bore seal stab 78 of the running tool 76 includes an orientation slot or keyway 80 longitudinally engageable over a key 82 projecting radially into the tubing hanger production bore 84. An optional orientation helix 86 is provided on the bottom of the seal stab 78, for coarse alignment of the running tool 76 to the tubing hanger 12. Provision of an orientation key and keyway at the interior surface of a concentric tubing hanger production bore provides simple and direct passive orientation between the tubing hanger and the running tool, without reliance on orientation components carried by a BOP.

Figure 5:
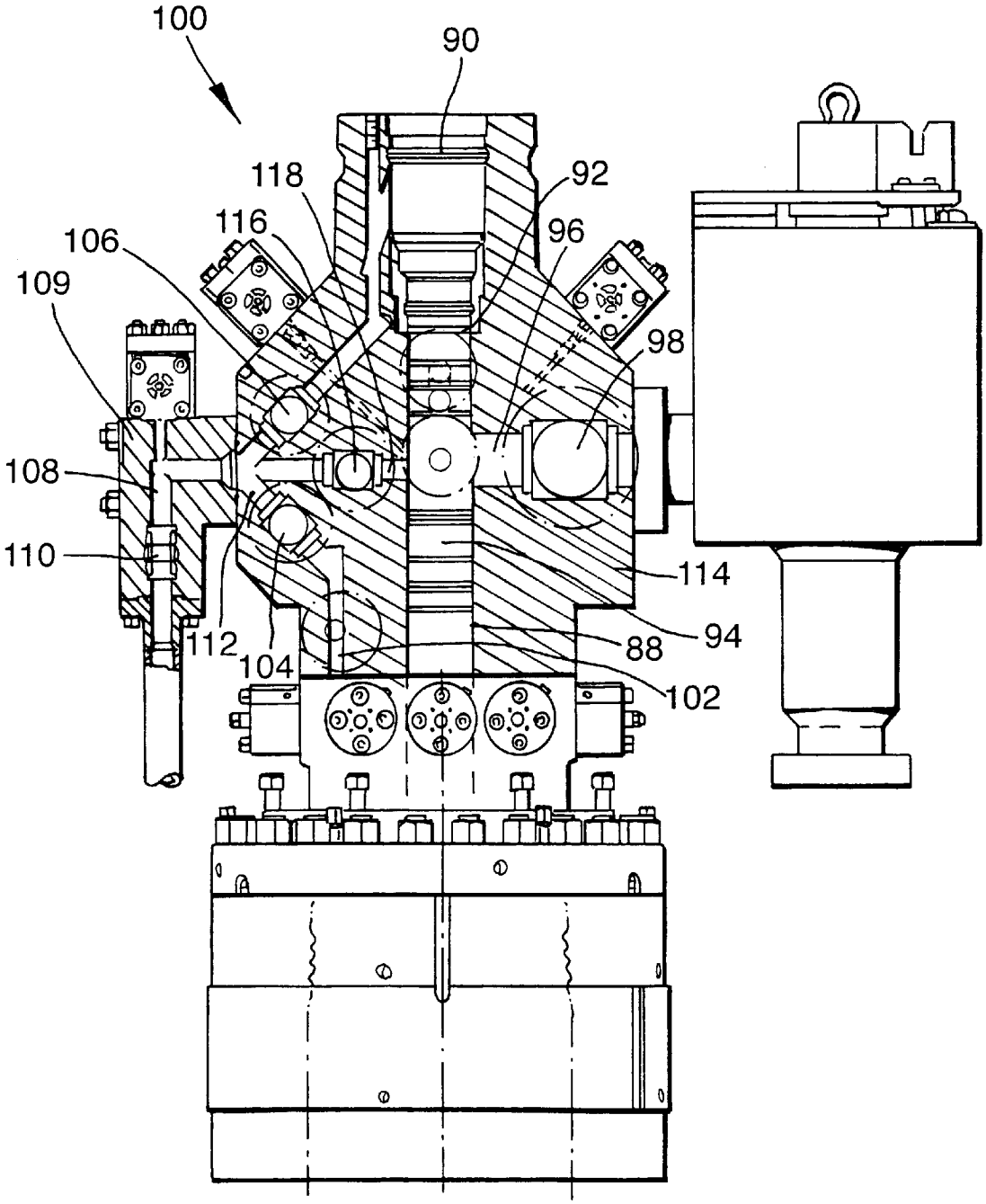
FIG. 5 shows a first embodiment of the Christmas tree of the invention.
Figure 6:
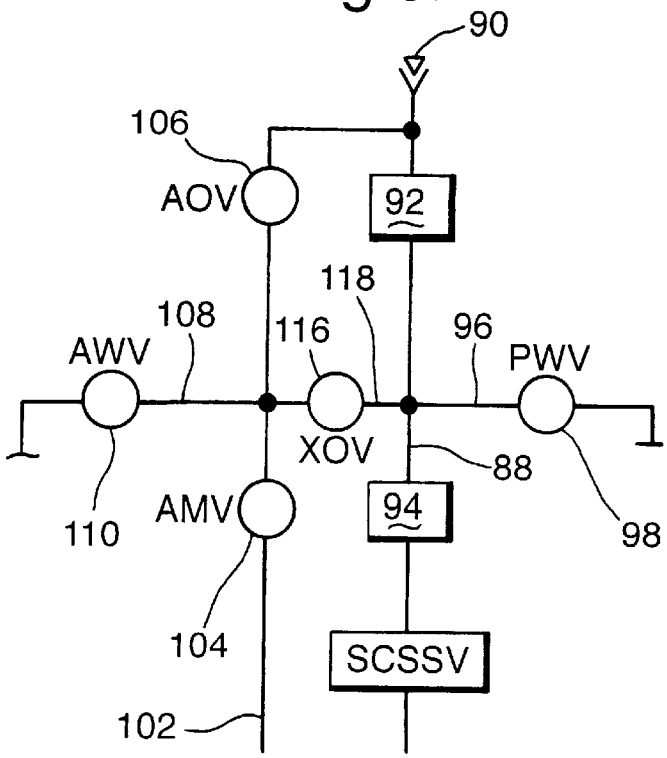
FIG. 6 is a fluid circuit diagram of the tree of FIG. 5.

FIGS. 5 and 6 show one possible layout of a Christmas tree 100 according to the invention. The Christmas tree production bore 88 is closed at its upper end by an internal tree cap 90, below which are positioned two crown plugs 92, 94 in series. Plug 94 replaces the conventional production master valve and plug 92 replaces the conventional production swab valve, thereby eliminating the bulk and weight of the associated valve actuators. The upper crown plug 92 together with the tree cap 90 maintains a permanent dual pressure barrier in the tree production bore.

A production outlet branch 96 is connected to the production bore 88 between the two plugs 92, 94. A 6⅜ inch (162 mm) production wing valve 98, which may be a conventional gate valve, is provided in the outlet branch 96.

An annulus flow conduit 102 is provided in the tree, connected to the conduit 40 and void 34, FIG. 1. This conduit 102 contains an annulus master valve 104 and annulus outlet valve 106. An annulus line 108 is branched off the annulus flow conduit 102 from between the valves 104, 106 and contains an annulus wing valve 110. The valves 104, 106, 110 may be conventional gate valves and together maintain the dual pressure barrier philosophy for the annulus conduit.

As shown more particularly in FIG. 5, the annulus flow conduit 102 contains a deviated portion 112 which provides space in the tree block 114 for a crossover valve 116, which again may be an otherwise conventional gate valve. Crossover valve 116 is provided in a crossover conduit 118 formed in the tree block and extending between the deviated portion 112 of the annulus flow conduit 102 and the production flow bore 88. This eliminates the need for a separately formed external crossover conduit. All of the tree valves, except the annulus wing valve 110, are integrally formed with the tree block 114. Annulus wing valve 110 is located within a separate manifold 109, bolted and sealed to the tree block 114.

Figure 8:
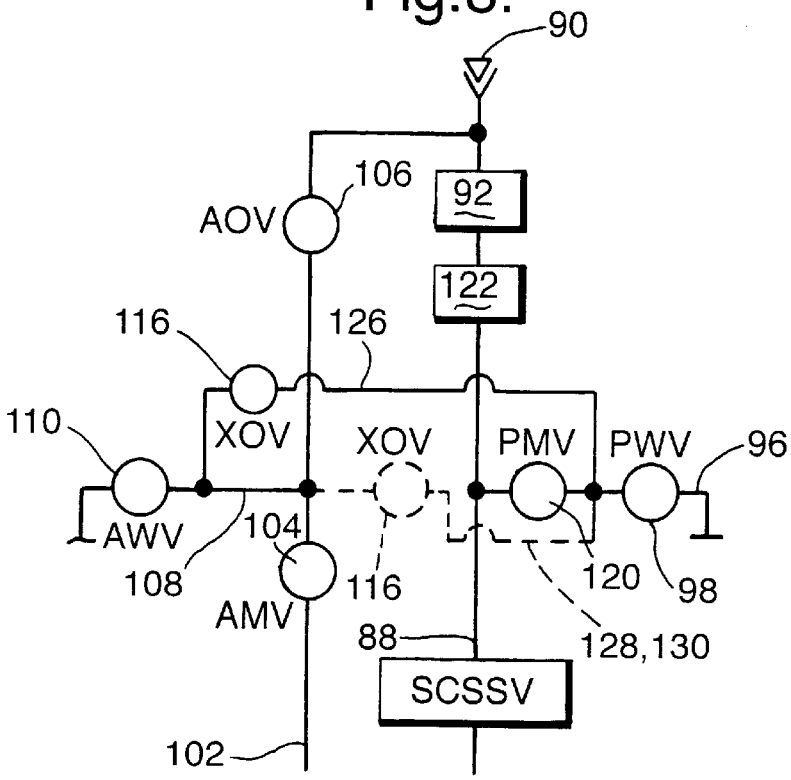
FIG. 8 is a fluid circuit diagram of the tree of FIGS. 7 and 7*a*.
Figure 7:
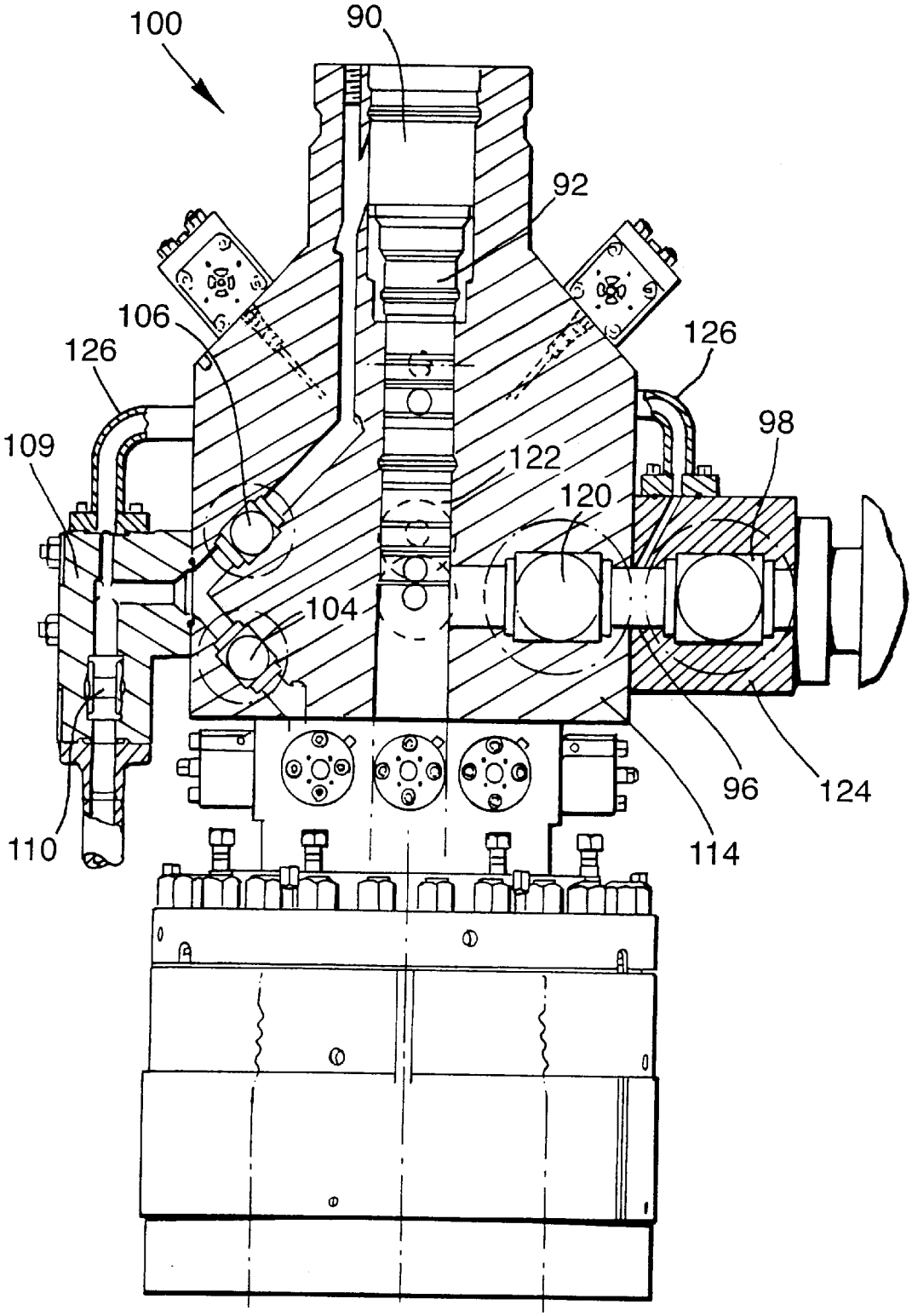
FIG. 7 shows a second embodiment of the Christmas tree of the invention.

FIGS. 7 and 8 show an alternative tree layout that is similar to the one of FIGS. 5 and 6, but which differs in that a production master valve 120 is provided upstream of the production wing valve 98 in the production outlet branch 96, replacing the crown plug 94. A second crown plug 122 is provided in the production flow bore 88 above the production outlet branch 96, in addition to the crown plug 92, to maintain a dual pressure barrier. As shown in FIG. 7, the production wing valve 98 is situated in a separate valve block 124. A separately fabricated external flow loop 126 forming the crossover conduit connects the production outlet branch 96 in the valve block 124 with the annulus line 108 in the manifold 109, between the annulus wing valve 110 and the annulus line 108/annulus flow conduit 102 junction. A crossover valve 116 (not visible in FIG. 7) is provided in the external flow loop 126.

The two crown plugs 92, 122 maintain the permanent dual pressure barrier in the tree production bore and the tree cap 90 is therefore optional in this embodiment. Where the tree cap 90 is not used, a debris plate (not shown) can be located above the upper plug 92 if desired, to ensure that stray objects falling onto the tree do not block access to the crown plugs.

Figure 7A:
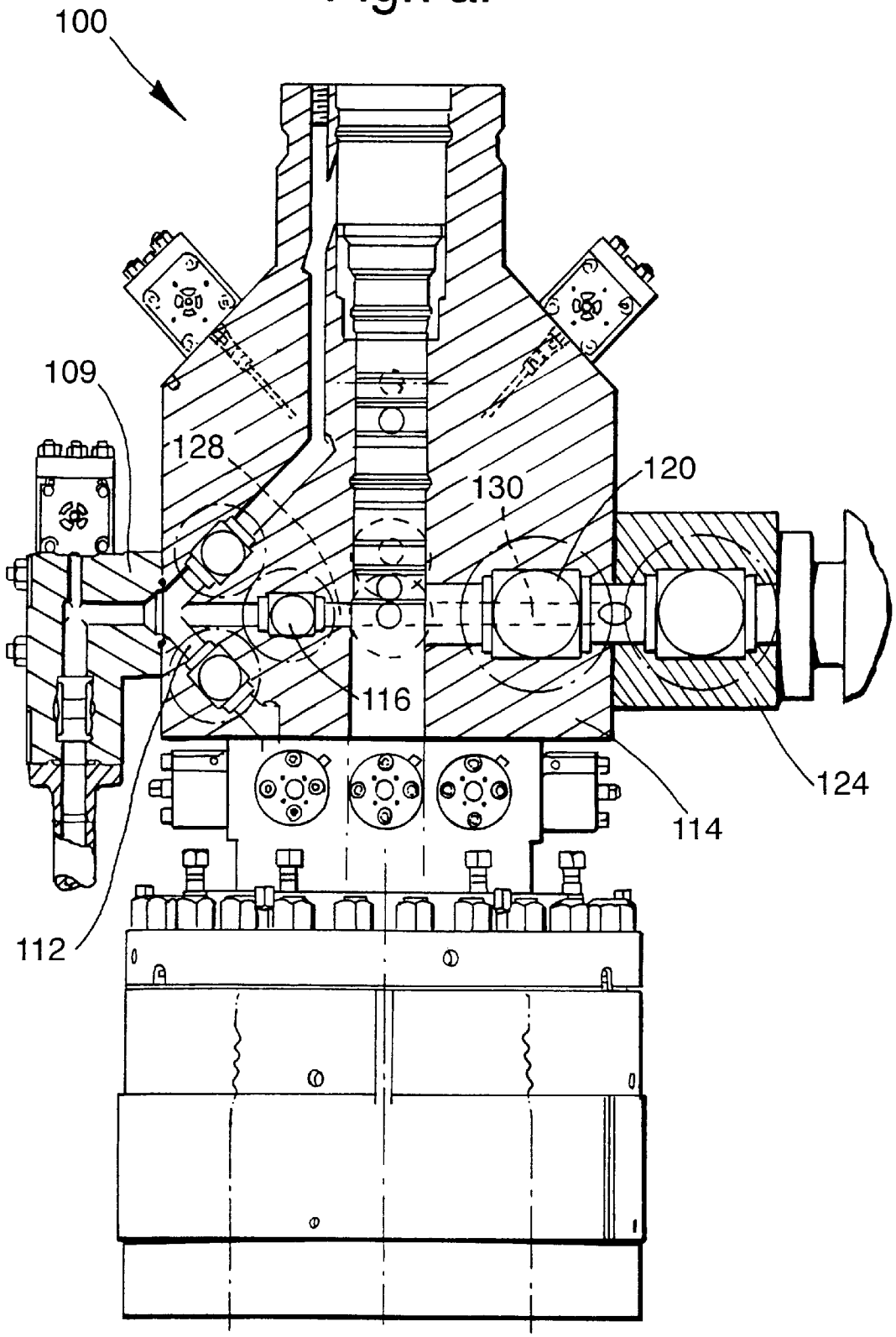
FIG. 7*a* shows a modification of the second embodiment.

FIG. 7*a* shows a modification of FIG. 7, in which the flow loop 126 is replaced by a crossover conduit formed in the tree block 114 by a pair of drillings 128, 130. These extend behind the plane of the drawing and intersect each other behind the production bore 88 as shown. Drilling 130 intersects the production outlet branch 96 at the junction between the production wing valve block 124 and the tree block 114. A crossover valve 116 is provided in a position accommodated by the deviated portion 112 of the annulus flow conduit 102, in like manner to FIG. 5. The crossover conduit and crossover valve 116 of FIG. 7*a* is represented in FIG. 8 in dotted lines. However, because this internal crossover conduit is relatively difficult to manufacture, the external flow loop and crossover valve of FIG. 7 may be more practical.

The invention in its preferred forms provides a large bore concentric tubing hanger with an integral, offset, pressure balanced annulus shuttle valve. The shuttle valve is located in such a way that it has minimal impact on the functionality and size of the tubing hanger and provides the primary means of retaining annulus fluids. The invention may be utilized in order to maximize the diameter of the production tubing and the number of downhole service lines. The invention advantageously provides a conventional concentric bore subsea Christmas tree system that can accommodate the largest possible diameter production bore. With such a system there need be no dog leg at the interface of the Christmas tree and tubing hanger production bores. Tree height and weight may be minimized by re-configuring the associated valves and adopting a tree pressure barrier philosophy similar to that of a horizontal subsea Christmas tree, using two plugs in the production bore, rather than valves. The system is of relatively simple configuration and may employ a riser and tooling similar to those used with horizontal tree systems. This offers some potential for standardization between tree types. Compatibility with existing concentric subsea test trees and monobore riser technology is also provided, with the subsea test tree stackup achievable below the BOP shear rams. The tubing hanger and Christmas tree may be designed to retain 10,000 psi (68.9 $MNm^{-2}$) working pressure. Continuous monitoring of downhole electrical and hydraulic equipment is possible while the completion is being run or pulled, by virtue of the tubing hanger/running tool orientation system, which allows connection of downhole service lines to appropriate service couplers in the running tool. It also allows passive re-engagement of the tubing hanger running tool to the tubing hanger during retrieval or intervention operations.

What is claimed is:

1. A tubing hanger comprising:

a substantially centrally located production flow bore formed within the tubing hanger;

a closeable tubing annulus passage radially offset with respect to the production flow bore; and a remotely operable valve in communication with the tubing annulus passage to close the tubing annulus passage, wherein an upper end portion of the tubing hanger adapted for connection to a Christmas tree to define a void in which a plurality of circumferentially spaced couplers are accommodated, each coupler connected to a service line extending through the tubing hanger, the valve communicating with the void whereby each coupler is bathed in a fluid.

2. A tubing hanger in accordance with claim 1, wherein the valve is located at an upper end of the tubing annulus passage.

3. A tubing hanger in accordance with claim 1, wherein the valve is a pressure balanced valve.

4. A tubing hanger in accordance with claim 1, wherein the void communicates with the Christmas tree by means of at least one drilling extending from the void into the Christmas tree.

5. A tubing hanger comprising:

a substantially centrally located production flow bore;

a closeable tubing annulus passage radially offset with respect to the production flow bore;

a remotely operable valve in communication with the tubing annulus passage to close the tubing annulus passage, the valve communicating with a void defined by an upper end portion of the tubing hanger adapted for connection to a Christmas tree in which a plurality of circumferentially spaced couplers are accommodated, each coupler connected to a service line extending through the tubing hanger; and a running tool, the running tool having a recess longitudinally engageable with a projection extending radially into the production flow bore, whereby the running tool may be orientated for engagement with the tubing hanger.

6. A tubing hanger in accordance with claim 5, wherein the running tool has an orientation helix to guide the projection into the recess.

7. A tubing hanger in accordance with claim 5, comprising one of a recess and a projection for longitudinal engagement with a complementary one of a projection and recess on a Christmas tree to provide alignment between the Christmas tree and the tubing hanger.

8. A Christmas tree comprising:

a body forming a tree production flow bore, a lower end of the tree production flow bore in communication with a tubing hanger production bore;

an annulus flow conduit, a lower end of the annulus flow conduit in communication with a tubing hanger tubing annulus passage;

a crossover conduit positioned within the body to connect the tree production flow bore and the annulus flow conduit; and a crossover valve arranged to control fluid flow within the crossover conduit, wherein the annulus flow conduit has a deviated portion within the body, allowing room for the crossover valve in the body.

9. A Christmas tree in accordance with claim 8, wherein the tree production flow bore has an upper end at a top of the body and is sufficiently aligned with the tubing hanger production bore to allow a wireline access to the tubing hanger production bore through the upper end.

10. A Christmas tree in accordance with claim 9, comprising a production outlet branch connected to the tree production flow bore, the production outlet branch having a production wing valve, wherein one of the at least two removeable plugs is positioned in the tree production flow bore above the production outlet branch and another of the at least two removeable plugs is positioned in the tree production flow bore below the production outlet branch.

11. A Christmas tree in accordance with claim 8, wherein the tree production flow bore is coaxial with the tubing hanger production bore, the tubing hanger production bore substantially centrally located within a tubing hanger.

12. A Christmas tree in accordance with claim 11, comprising a production outlet branch connected to the tree production flow bore, the production outlet branch having a production wing valve, wherein one of the at least two removeable plugs is positioned in the tree production flow bore above the production outlet branch and another of the at least two removeable plugs is positioned in the tree production flow bore below the production outlet branch.

13. A Christmas tree comprising:

a body forming a tree production flow bore, a lower end of the tree production flow bore in communication with a tubing hanger production bore;

an annulus flow conduit, a lower end of the annulus flow conduit in communication with a tubing hanger tubing annulus passage;

a crossover conduit positioned within the body to connect the tree production flow bore and the annulus flow conduit, the annulus flow conduit having a deviated portion within the body, allowing room for a valve in the body; and a production outlet branch connected to the tree production flow bore, the production outlet branch having a production wing valve, wherein one of at least two removeable plugs is positioned in the tree production flow bore above the production outlet branch and another of the at least two removeable plugs is positioned in the tree production flow bore below the production outlet branch.

14. A Christmas tree comprising:

a production flow bore having a lower end in communication with a tubing hanger production bore;

an annulus flow conduit having a lower end in communication with a tubing hanger tubing annulus passage; and at least two removable plugs positioned in series in the production flow bore to act as pressure barriers.

15. A Christmas tree in accordance with claim 14, comprising a production outlet branch connected to the production flow bore, the production outlet branch having a production wing valve, wherein one of the at least two removeable plugs is positioned in the production flow bore above the production outlet branch and another of the at least two removeable plugs is positioned in the production flow bore below the production outlet branch.

16. A Christmas tree in accordance with claim 14, comprising a production outlet branch connected to the production flow bore, the production outlet branch having a production master valve and a production wing valve in series, the at least two removable plugs positioned in the production flow bore above the production outlet branch.

17. A Christmas tree in accordance with claim 16, comprising a crossover flow conduit having a crossover valve, the crossover flow conduit extending from between the production master valve and the production wing valve in the production outlet branch to the annulus flow conduit.

18. A Christmas tree in accordance with claim 17, wherein the crossover flow conduit comprises a flow loop external to a tree block.

19. A Christmas tree in accordance with claim 14, further comprising an internal tree cap positioned at an upper end of the production flow bore.

20. A Christmas tree in accordance with claim 19, wherein an upper crown plug and a lower crown plug are positioned below the internal tree cap, the upper crown plug and the tree cap maintain a permanent dual pressure barrier in the production flow bore.

* * * * *